US005527171A

United States Patent [19]

Soerensen

[11] Patent Number: 5,527,171

[45] Date of Patent: Jun. 18, 1996

[54] APPARATUS FOR DEPOSITING FIBERS

[75] Inventor: Birger E. Soerensen, Vejle Oe, Denmark

[73] Assignee: Niro Separation A/S, Denmark

[21] Appl. No.: 207,058

[22] Filed: Mar. 8, 1994

[30] Foreign Application Priority Data

Mar. 9, 1993 [DK] Denmark ..... 0265/93

[51] Int. Cl.[6] ..... D01G 25/00; D04H 1/00

[52] U.S. Cl. ..... 425/83.1; 19/304; 425/81.1

[58] Field of Search ..... 425/80.1, 83.1, 425/81.1, 82.1; 19/301, 304

[56] References Cited

U.S. PATENT DOCUMENTS

| | | | |
|---|---|---|---|
| Re. 31,775 | 12/1984 | Persson | 425/83.1 |
| 3,576,349 | 4/1971 | Mark | 302/12 |
| 3,645,813 | 2/1972 | Pelikan et al. | 425/80.1 |
| 4,014,635 | 3/1977 | Krøyer | 425/82 |
| 4,060,360 | 11/1977 | Tapp | 425/83.1 |
| 4,144,619 | 3/1979 | White et al. | 19/304 |
| 4,193,751 | 3/1980 | Miller | 425/83.1 |
| 4,494,278 | 1/1985 | Krøyer et al. | 425/83.1 |
| 4,628,571 | 12/1986 | Marx et al. | 19/304 |

FOREIGN PATENT DOCUMENTS

| | | |
|---|---|---|
| 144382 | 3/1982 | Denmark . |
| 147542 | 9/1984 | Denmark . |
| 153530 | 7/1988 | Denmark . |
| 162845 | 12/1991 | Denmark . |
| 467740 | 9/1992 | Denmark . |
| 2623008 | 12/1976 | Germany . |
| 2008638 | 6/1979 | United Kingdom . |

*Primary Examiner*—James P. Mackey
*Attorney, Agent, or Firm*—Brooks & Kushman

[57] ABSTRACT

An apparatus for depositing fibers on a wire (12) for the production of primarily paper products includes a wire (12) and one or more distributors (1) which are diagonal in relation to the wire (12). This minimizes disadvantages which occur when using traditional apparatuses as, in the present invention, impellers (2) mounted in the distributor (1) are provided in rows (4) which, like the distributor (1), are arranged at an angle between 0° and 90° in relation to the direction of movement (D) of the wire (12).

8 Claims, 4 Drawing Sheets

APPARATUS FOR DEPOSITING FIBERS

BACKGROUND OF THE INVENTION

The present invention relates to an apparatus for depositing air-suspended fibers on a wire to produce a substantially plane fibrous web on the wire, apparatus being provided with at least one distributor which comprises a housing, means for supplying fibers, and at least two parallel rows of impellers which rotate, when in use, around an axis which is substantially perpendicular to the wire, the impellers being situated between the supply means and a net behind which the wire is provided in such a manner that the fibers will flow from the supply means via the impellers and the net to the wire.

In the production of napkins and new sanitary products, especially sanitary towels for women and incontinent persons, the possibilities of producing increasingly thin products have increased in recent years. The consumers of course demand that these napkins or sanitary towels have the same absorbency as the previously known, more solid products. Therefore, it is essential to maintain a homogeneous product quality as the product is more optimized in thickness than it was previously. For the manufacture of products of the above-mentioned type, the web is subsequently cut into narrow strips which are used in the final products. The manufacturer of such final products demands that the strips cut from the web have a homogeneous thickness in order to secure homogeneous product quality. Homogeneous product quality is not only vital to the properties of the products in subsequent treatment, but also in order to secure that the products will occupy the very same volume when packed and not more or less of the packaging volume for the same amount of products.

GB 2,008,638 and DK 144,382 disclose such an apparatus with several, preferably four, parallel rows of rotating impellers. The rows form a 90° angle on the axis along which a wire below extends, and each of the rotating impellers rotates in its own section of the distributor. A net is situated between the impellers and the wire. This causes a sausage-shaped body of fibers to be formed between the parallel rows, the fibers falling or being sucked gradually from the body down through the net and onto the wire. It appears, however, that problems arise related to keeping a homogeneous thickness profile over the fibrous layer formed on the wire.

SE 467,740 discloses an apparatus that seeks to remedy the above problem. The apparatus used corresponds to the apparatus disclosed in the above-mentioned British and Danish publications. The difference consists in the use of a special net with different mesh sizes. The mesh size is larger under the impellers as it has been found that the fibrous layer formed on the wire, especially in the area below the center of the impellers, will be thinner than elsewhere in the fibrous layer. The disadvantage of the manner in which the Swedish publication seeks to achieve a homogeneous thickness of the fibrous layer on the wire is that it is difficult and involves large expenditures to produce the nets with different mesh sizes. Furthermore, it is necessary to use different nets depending on the types of fibers used for the production of the fibrous layer, and similarly the choice of mesh sizes depends on the size and the density of the fibers.

As it appears, the use of the prior art apparatuses has made it difficult to maintain a sufficiently homogeneous product quality because the fibrous layer formed on the wire does not possess the homogeneity of thickness that is required. This has caused the products within the same production line to fail to have the same properties. Besides, the non-homogeneous thickness of the products has had the disadvantage that the product packaging, which has also been optimized along with the optimization of the products, is bigger than necessary in some cases and too small in other cases.

Thus, it is the object of the present invention to minimize the above-mentioned disadvantages and provide an apparatus for the production of a fibrous web on a wire in which the layer thickness is homogeneous throughout the web.

SUMMARY OF THE INVENTION

This object is achieved by an apparatus of the aforementioned type which is characterized in that each of the parallel rows forms an angle between 0° and 90° with respect to the direction of motion of the wire.

With this apparatus it is possible to achieve considerable improvements in the thickness variation across the fibrous web formed on the wire. Improvements are achievable at a factor of 2 to 5. Whereas previously it was possible to achieve thickness variations of ±5% without the use of especially produced nets, with the apparatus according to the present invention it is now possible to reduce the thickness variation to ±1%.

The apparatus according to the present invention is designed in such a manner as to avoid that the centers of the impellers are situated along a curve parallel to the direction of motion of the wire. In this manner it is possible to minimize the risk that non-homogeneity occurs in the thickness of the fibrous web formed on the wire.

Sausage-shaped bodies of fibers formed between the parallel rows of rotating impellers will still be present as in the prior art. In most cases this is a precondition for the formation of a fibrous layer with a homogeneous thickness. Unlike the prior art apparatuses, however, the longitudinal axis of the sausage-shaped bodies forms an angle with respect to the direction of motion of the wire. This means that any systematic imperfections in a sausage-shaped body, which are reproduced in each of the sausage-shaped bodies formed between the respective rows of rotating impellers, may indeed be present in the same location relative to the impellers and the sausage-shaped bodies, but not relative to the wire on which the fibrous layer is formed.

According to a preferred embodiment, the rotating impellers are situated in the same plane, however with overlapping sweeping zones. This is achieved by letting the impellers be displaced at an angle with each other in such a manner that, during rotation, the individual parts of an impeller will in turn enter the space between the individual parts of a corresponding adjacent impeller like gear wheels, however without the impellers touching each other. This embodiment reduces the systematic imperfection which could occur in the space between the individual impellers since that space does not exist.

In order to minimize any further imperfections, several distributors, preferably two, may be used according to the preferred embodiment. This increases the production capacity of the apparatus. In apparatuses with several distributors, it is further possible to deposit different types of fibers in the same web on the wire. The distributors of an apparatus with several distributors may be identical and comprise the same number of rows of impellers and be directed in the same direction so that they form the same angle with the wire. Alternatively, however, the distributors may be different with different numbers of impeller rows with different impeller types, and similarly they may be directed in different directions in order to form different angles with the wire.

In order to prevent the fibrous web deposited on the wire from having less thickness in the edge areas than in the middle, the distributor is equipped with a shield. This shield is designed in such a manner that only some of the fibers supplied to the distributor will be transmitted through the net. Only those fibers that are supplied to the part of the distributor located over the wire will be led through the net whereas the remaining fibers which are supplied to the edge areas on each side of the distributor are recirculated.

The invention will now be described in further detail with reference to the attached drawings.

DETAILED DESCRIPTION OF THE PREFERRED EMBODIMENTS

Figure 1:
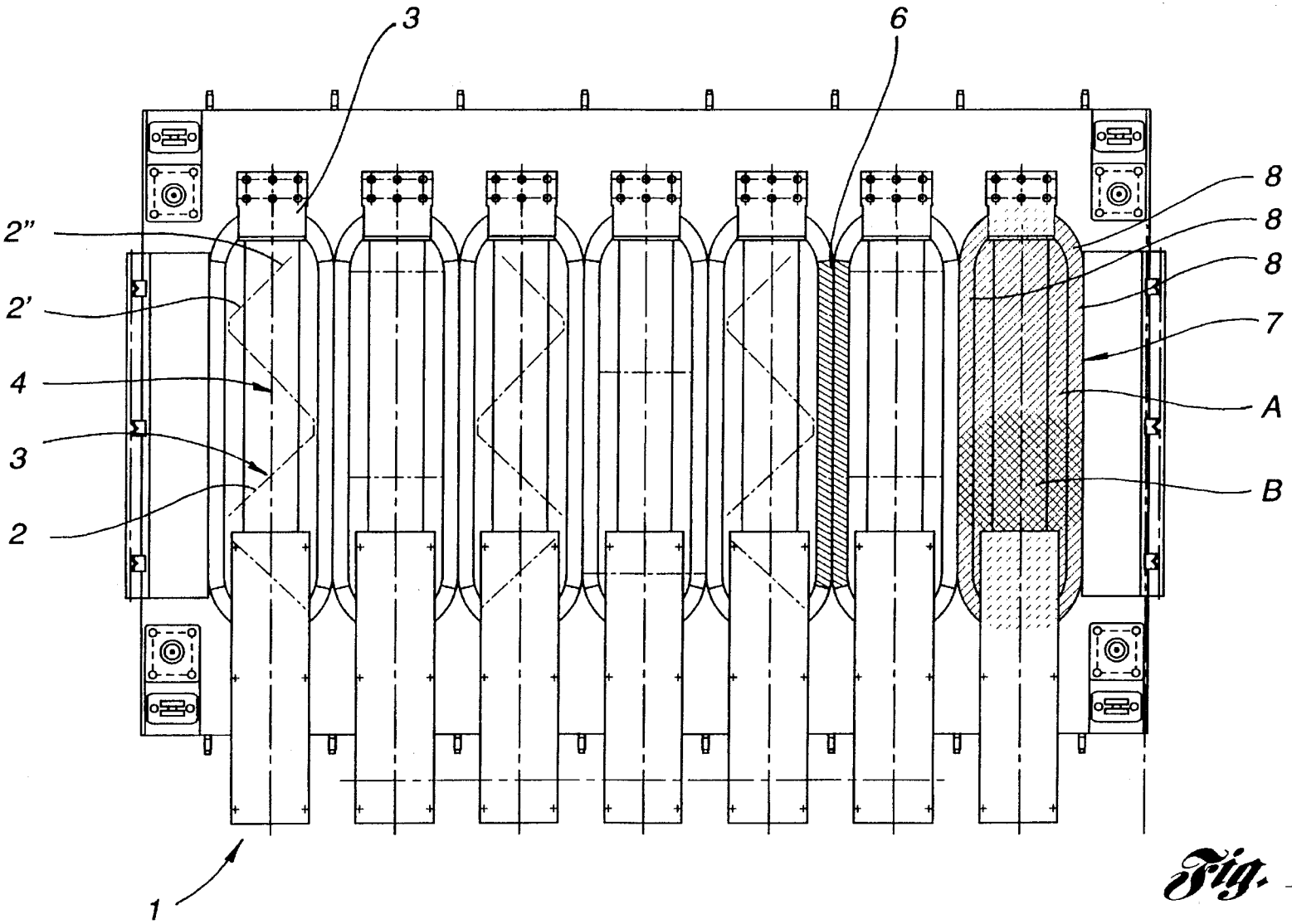
FIG. 1 shows a distributor according to the invention seen from above.

FIG. 1 shows a distributor 1 according to the invention seen from above. The distributor 1 is designed in such a manner that suction which is applied by suction means (not shown) under a wire (not shown) and under the distributor will supply air-suspended fibers through the distributor in order to deposit the fibers in a layer on the wire.

Inside the distributor 1, impellers 2 are mounted on vertical axes 3. The vertical axes 3 serve as rotation axes for the impellers 2 and are arranged in parallel rows 4. In the illustrated embodiment seven parallel rows 4 with four impellers 2 are provided in each row. The impellers 2 are rotated by motors 5 which are arranged at each row 4 (see FIG. 2). Each of the motors 5 drives one horizontal axle 6 (see FIG. 2) which drives the impellers 2 via a gear (not shown). As it appears from the illustrated embodiment, the impellers 2 consist of two halves 2' and 2" on either side of the rotation axis 3. Alternatively, the impellers 2 could consist of three or more parts arranged symmetrically around the rotation axis 3. The impellers 2 in each row 4 form a 90° angle with the adjacent impeller, so that a certain reciprocal constellation of the impellers will occur for every four rows. The impellers 2 in each row 4 rotate in the same direction, but in the opposite direction of the impellers in an adjacent row. Furthermore, the impellers 2 in each row are arranged in such a manner that the zones swept by the impellers overlap. The impellers of several rows may rotate in the same plane, and the zones which are swept by the impellers of different rows may overlap. The impellers are preferably arranged in the same plane, however they might also be arranged in different planes, possibly combined with different impeller designs.

Immediately above the plane in which the impellers rotate, along an edge 7 of a total area A of zones B which are swept by the impellers 2 in each row 4, are inclined plates 8 which lead the fibers from above down toward the impellers 2. The inclined plates 8 form a vague funnel-shape above the impellers. In the area C, between the two rows 4 of rotating impellers 2 and under the inclined plates 8, a sausage-shaped body of fibers is formed during the rotation of the impellers. It is from this body of fibers that the fibers fall or get sucked down through a net (see FIG. 2) and onto the wire (see FIG. 3).

Figure 2:
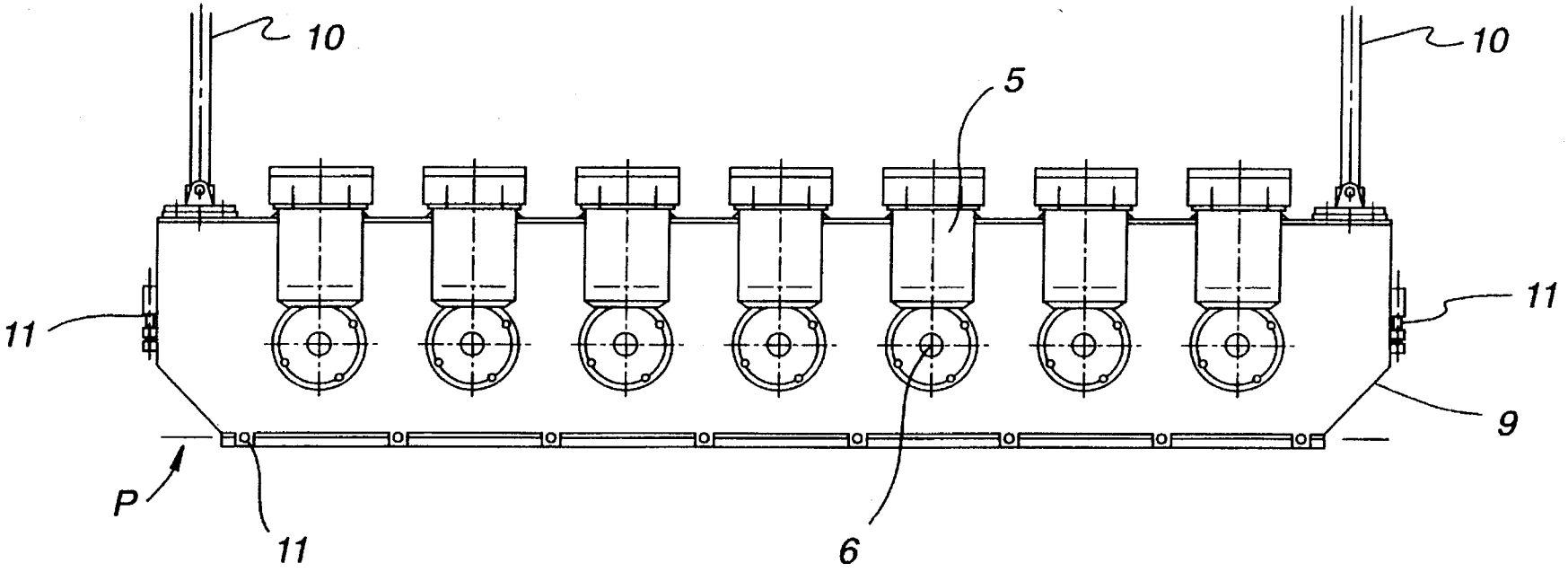
FIG. 2 shows a distributor according to the invention seen from the side.

FIG. 2 shows a distributor 1 seen from the side. The distributor 1 comprises a housing 9 which surrounds the impellers 2. Accordingly, only the motors 5 and one end of the axles 6 can be seen in the figure. The distributor 1 is provided with control means 10 for adjusting the distance of the distributor in relation to the rest of the apparatus. The distributor is provided with members 11 for holding and stretching the net (not shown) which are situated in the plane P inside the distributor 1. The plane which is swept by the impellers 2 is situated immediately above the plane P. The means for supplying fibers to the upper part of the distributor are not shown. The apparatus may be provided with control means for adjusting the distance between the distributor and the forming wire and the angle of the distributor and the parallel rows relative to the direction of the wire.

Figure 3:
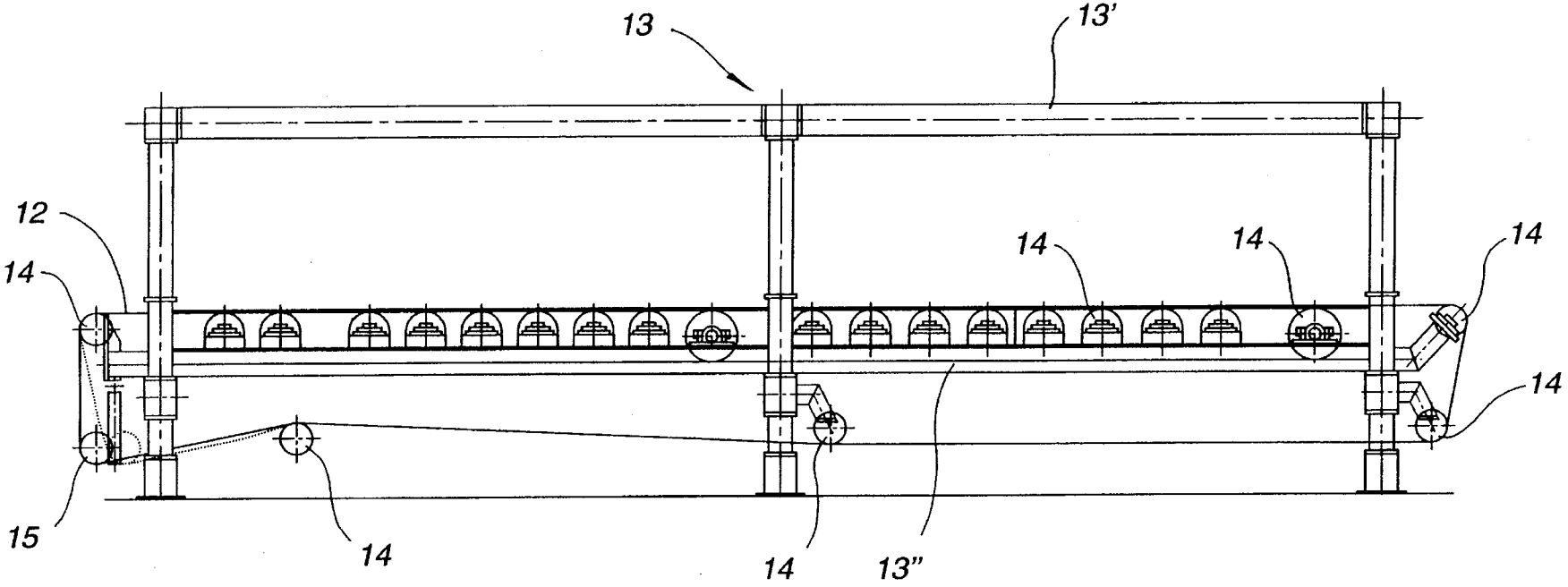
FIG. 3 shows an apparatus seen from the side with a wire, but without its distributor(s)

FIG. 3 shows part of an apparatus with a wire 12 but without distributor(s). The apparatus comprises, inter alia, a frame 13 which consists of several girders. The upper girders 13' are intended for support of the distributor by means of the control means 10 (see FIG. 2). The wire 12 extends as an endless band around fixed rolls 14 which rest on lower girders 13". In order for the wire 12 to be continuously kept stretched, in addition to the fixed rolls 14 the apparatus comprises a roll 15 loaded by a spring or other flexible means to keep the wire taut.

Beneath the wire 12 in the entire apparatus a suction device (not shown) will be mounted which sucks air-suspended fibers from the distributor, down past the impellers, down through the net and onto the wire. In that end of the apparatus where the final fibrous web runs out, the web is removed from the wire and transmitted for further treatment.

Figure 4:
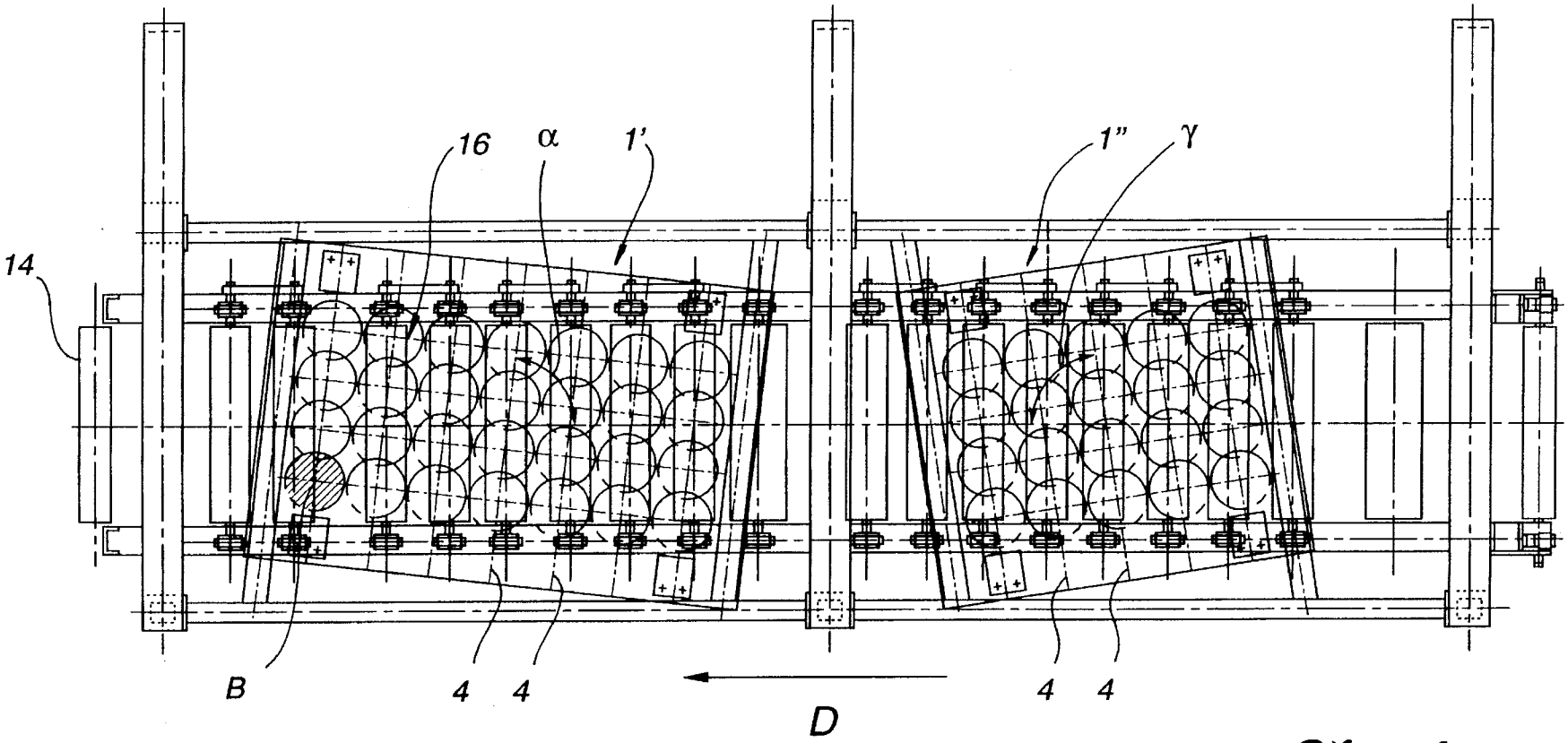
FIG. 4 shows an apparatus according to the invention with two distributors, seen from above.

FIG. 4 shows an apparatus according to the invention. Two distributors 1' and 1" are arranged above the wire (not shown) in such a manner that the parallel rows 4 in which the impellers 2 are disposed form angles $\alpha$ and $\gamma$ in relation to the direction of motion of D of the wire. The angle $\alpha$ or $\gamma$ that is formed may be between 0° and 90°, preferably however between 75° and 90°. The two distributors 1' and 1" are provided with seven and five, rows 4 of impellers 2, respectively, which are arranged in such a manner that they cover an equally big width b of the apparatus. In the shown embodiment the rotation axes 3 of the impellers 2 in the same row 4 are disposed in parallel planes coincident with the parallel rows 4. Furthermore, the rotation axes of the impellers in different rows are also disposed in parallel planes coincident with straight curves 16 which extend perpendicularly to the rows 4. However, it would be possible to arrange the impellers in such a manner that the curves 16 are not straight and do not extend perpendicularly to the rows but have an arbitrary geometrical shape.

In this figure and in FIG. 1, all the impellers 2 are illustrated as having the same dimensions so that the zone B which is to be swept by the impellers is equally big and has the same diameter. Alternatively, the impellers 2 may have different dimensions (diameters) and different shapes so that the diameter of the zone to be swept is different for different impellers.

The combination of the diagonal distributors 1' and 1", the overlapping impellers 2 in each row 4 and the distributors with different numbers of rows but covering the same width b, achieves the object of minimizing systematic imperfections so that the thickness of the fibrous web formed on the wire 12 becomes very homogeneous.

The apparatus according to the invention consists to a great extent of known components; however, it is the combination of those in a new manner that results in the substantial improvement of the quality of the final product. The embodiments illustrated in the figures are not to be considered as limitations of the present invention.

In the illustrated embodiments, the apparatus according to the invention has been described with regard to the fact that the apparatus will primarily be used with the wire in a horizontal plane and the impellers rotating around vertical axes. However, it is also possible to use the apparatus more or less inclined.

I claim:

1. An apparatus for producing a fibrous web having a homogeneous thickness, said apparatus comprising:

a forming wire which is mounted to move in a straight direction of motion, a distributor positioned adjacent to said forming wire to distribute fibers thereon, said distributor comprising a housing which defines an open end facing said forming wire, a net which is mounted on said housing to cover said open end, means for supplying fibers to said housing, and a plurality of impellers located within said housing and rotatable around axes which extend perpendicularly to a plane formed by said forming wire as said forming wire passes by said open end of said housing, said plurality of impellers being aligned in at least two parallel rows which extend at an angle of greater than 0° and less than 90° to said straight direction of motion of said forming wire, said impellers distributing air-suspended fibers towards and through said net for deposition on said forming wire.

2. An apparatus according to claim 1, wherein the parallel rows form an angle of greater than 75° and less than 90° with respect to the direction of motion of the forming wire.

3. An apparatus according to claim 1, wherein the impellers rotate in a horizontal plane when in use and in which the impellers comprise at least two identical impeller blades, wherein zones which are swept by impellers in a row overlap one another.

4. An apparatus according to claim 3, wherein impellers in a row have differing diameters.

5. An apparatus according to claim 1, wherein the impellers of several rows rotate in the same plane and wherein zones which are swept by impellers of different rows overlap.

6. An apparatus according to claim 1, including control means for adjusting a distance between the distributor and the forming wire and the angle of the distributor and the parallel rows relative to the direction of motion of the wire.

7. An apparatus according to claim 1, including a plurality of said distributors, wherein the parallel rows of one distributor form an angle relative to the direction of motion of the forming wire which is different from the angle relative to the direction of motion of the forming wire formed by the parallel rows of at least one of the other distributors.

8. An apparatus according to claim 1, including a plurality of said distributors, wherein each of the plurality of distributors is provided with different numbers of rows of impellers.

* * * * *